US005472136A

United States Patent [19]

Roccaforte

[11] Patent Number: 5,472,136

[45] Date of Patent: Dec. 5, 1995

[54] CARTON WITH HANDLE AND DEFLECTION REGIONS

[75] Inventor: Harry I. Roccaforte, Chicago, Ill.

[73] Assignee: Waldorf Corporation, St. Paul, Minn.

[21] Appl. No.: 394,448

[22] Filed: Feb. 27, 1995

[51] Int. Cl.[6] ..... B65D 5/462

[52] U.S. Cl. ..... 229/117.12; 229/117.09

[58] Field of Search ..... 229/117.09, 117.12, 229/117.13, 117.14

[56] References Cited

U.S. PATENT DOCUMENTS

| | | | |
|---|---|---|---|
| 2,762,555 | 9/1956 | Buttery | 229/117.12 |
| 2,868,433 | 1/1959 | Anderson, Jr. . | |
| 2,955,739 | 10/1960 | Collura . | |
| 2,986,324 | 5/1961 | Anderson, Jr. . | |
| 3,094,268 | 6/1963 | Swanson et al. . | |
| 3,794,239 | 2/1974 | Bonczyk | 229/117.13 |
| 4,378,905 | 4/1983 | Roccaforte . | |
| 4,411,383 | 10/1983 | Morris | 229/117.12 |
| 4,546,914 | 10/1985 | Roccaforte | 229/117.12 |
| 5,119,985 | 6/1992 | Dawson et al. | 229/117.12 |
| 5,307,987 | 5/1994 | Roccaforte | 229/117.13 |
| 5,328,081 | 7/1994 | Saulas | 229/117.12 |
| 5,346,064 | 9/1994 | Rizzuto . | |
| 5,346,121 | 9/1994 | Beales . | |

*Primary Examiner*—Gary E. Elkins
*Attorney, Agent, or Firm*—Schwegman, Lundberg & Woessner

[57] ABSTRACT

A carton which, as constructed, includes an integral, single-thickness carrying handle. The carton also includes deflection regions at the ends of the handle to effectively manage the forces generated when the carton is carried using the handle.

24 Claims, 7 Drawing Sheets

CARTON WITH HANDLE AND DEFLECTION REGIONS

TECHNICAL FIELD

The present invention relates to the field of paperboard cartons or receptacles with integral handles. More particularly, it relates to the field of cartons with integral carrying handles and deflection regions for managing stresses at the junction between the handles and the cartons.

BACKGROUND OF THE INVENTION

Paperboard cartons are used to package and transport a wide variety of products such as individual beverage containers, food items or other commodities such as detergents or cat litter. Carrying handles are helpful on such packages which can be both bulky and relatively heavy and, as a result, are not typically packaged into a bag for transport by a customer, but are rather carried separately.

Packages have been developed which include integral handles. Such packages, however, suffer from a number of disadvantages. One disadvantage is the requirement of a double thickness of material for the handle. This requires the use of more packaging material and can provide cartons with end panels of varying thickness which may be unstable when stacked for storage, shipment and display.

U.S. Pat. No. 2,868,433 (Anderson, Jr.) discloses a receptacle with an integral handle formed of two layers of paperboard to carry the receptacle and its contents. In addition to the disadvantages noted above for cartons employing double thickness handles, the Anderson, Jr. receptacle suggests that users may insert their fingers under the doubled portion of the flap, but provides no structure to facilitate the insertion of a user's fingers or hand for carrying the carton.

U.S. Pat. Nos. 3,094,268 (Swanson et al.) and 2,955,739 (Collura) also disclose cartons with carrying handles. These patents do provide a means for insertion of a user's fingers or hand under the handle, but in doing so they caused an additional disadvantage in that both cartons have openings into their interiors and, therefore, are not suitable for containing materials including powdered commodities such as soap, or granular materials such as rice, coffee, dog food or cat litter which could leak out of the openings in the cartons.

U.S. Pat. No. 2,986,324 to Anderson, Jr., discloses a carton having a single thickness strap formed in an overlapping end portion which is formed to overlap the entire end of a carton formed from the blank. This end portion includes a pair of cutouts to facilitate grasping the handle as well as score lines formed along its entire length to allow the handle to separate from the remainder of the panel 31. As a result, a reinforcing strap 60 is required to be placed over the handle 57 and to extend along the sides of the carton to provide attachment after score lines 51 and 52 have separated from the remainder of panel 31.

A disadvantage of this design is the need for additional material in providing handle 31 whose primary-function is to provide the paperboard portion 57 of the handle. A further disadvantage of this design is the absolute requirement for a reinforcing strap to run along the handle 50.

U.S. Pat. No. 4,378,905 to Roccaforte discloses a carton including a double thickness handle. Roccaforte discusses that openings 74 and 76 as depicted in FIG. 5 are optional, but it discourages such a design because of the additional creases that would tend to form in the package which would serve as a focal point for tearing. Such tearing could result in leakage of the carton's contents and, in some instances, failure of the handle formed as part of the carton.

SUMMARY OF THE INVENTION

The present invention provides a carton which, as constructed, provides an integral, single-thickness carrying handle. The carton includes deflection regions at the ends of the handle to effectively manage the forces generated when the carton is carried using the handle.

The carton includes side walls and first and a top wall connected to the side walls, wherein the top wall is formed from a first panel and a second panel, each foldably attached to one of the side walls and each having a free edge. The first and second panels are at least partially overlapped, i.e., the outermost panel extends over the inner panel for at least a portion of the width of the panels, and they are secured to each other. The handle is defined by a line of weakness in the first panel, the line of weakness being generally parallel to the free edge of the first panel and extending the length of the panel. The handle has a width that is less than the overlapping extent of the first and second panels.

The present invention also encompasses a flat, die cut and scored blank that is folded and locked or glued into the preceding carton configuration. The blank may be made from suitable caliper paperboard, other suitable materials or a combination thereof.

A feature of the carton of the present invention is the provision of deflection regions or areas which are formed on each side of the top wall of the fully constructed carton. The preferred deflection regions are generally triangular in shape and are formed by the scored fold lines in the first and second panels which together form the top end wall of the carton of the present invention.

The deflection regions manage and direct the forces generated when the carton is carried using the handle to prevent unwanted tearing or opening of the carton and while providing a substantially sealed carton for transporting granular powdered or particulate material without leakage.

A further advantage of the present invention is the provision of a single thickness carrying handle which facilitates stacking of cartons according to the present invention.

A yet further advantage of the present invention is the provision of a substantially sealed carton with a single thickness handle which uses a minimum amount of packaging material, thereby reducing the cost of the carton to the manufacturer.

The present invention is intended to encompass alternative embodiments wherein the deflection regions have shapes other than triangular, as long as the central region of the top wall may be deflected sufficiently to facilitate the separation of the integral handle from the outermost of the first and second panels as well as the grasping of the handle.

These and other various features and advantages of the present invention will be apparent upon a reading of the detailed description of the preferred embodiment provided below.

DETAILED DESCRIPTION OF THE PREFERRED EMBODIMENT

Figure 6:
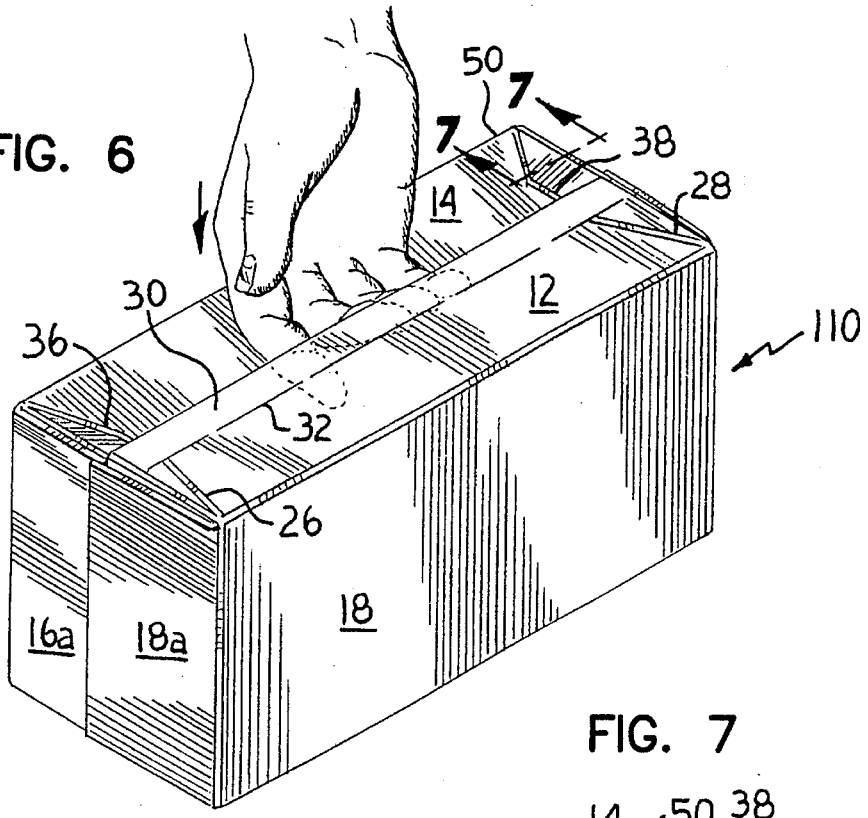
FIG. 6 is a perspective view depicting an initial step in a consumer's use of the carton of FIG. 5, i.e., forcing a panel forming the top wall downward.

References to right and left, top and bottom, upper and lower and horizontal and vertical are to be read and understood with their conventional meanings and with reference to the carton of the present: invention as shown in FIG. 6. However, the use of these terms is to facilitate the description and understanding of the carton and the blank for forming it. Thus, such terms are merely illustrative of the carton and blank are not intended to limit the carton or blank to any specific orientation.

With regard to means for fastening, attaching or connecting the components and structures of the present invention to form the carton as a whole, unless specifically limited or described, such means are intended to encompass conventional fasteners such as adhesives and the like. Generally, unless specifically otherwise disclosed or taught, the material from which the carton of the present invention and portions thereof is formed may be selected from appropriate material such as paperboard, corrugated paperboard, various plastics, suitable laminates or the like.

In the FIGURES, except where otherwise indicated, double lines indicate scores used to form fold lines, single solid lines indicates cuts or free edges and single dashed lines indicate partially cut or perforated lines of weakness.

Figure 1:
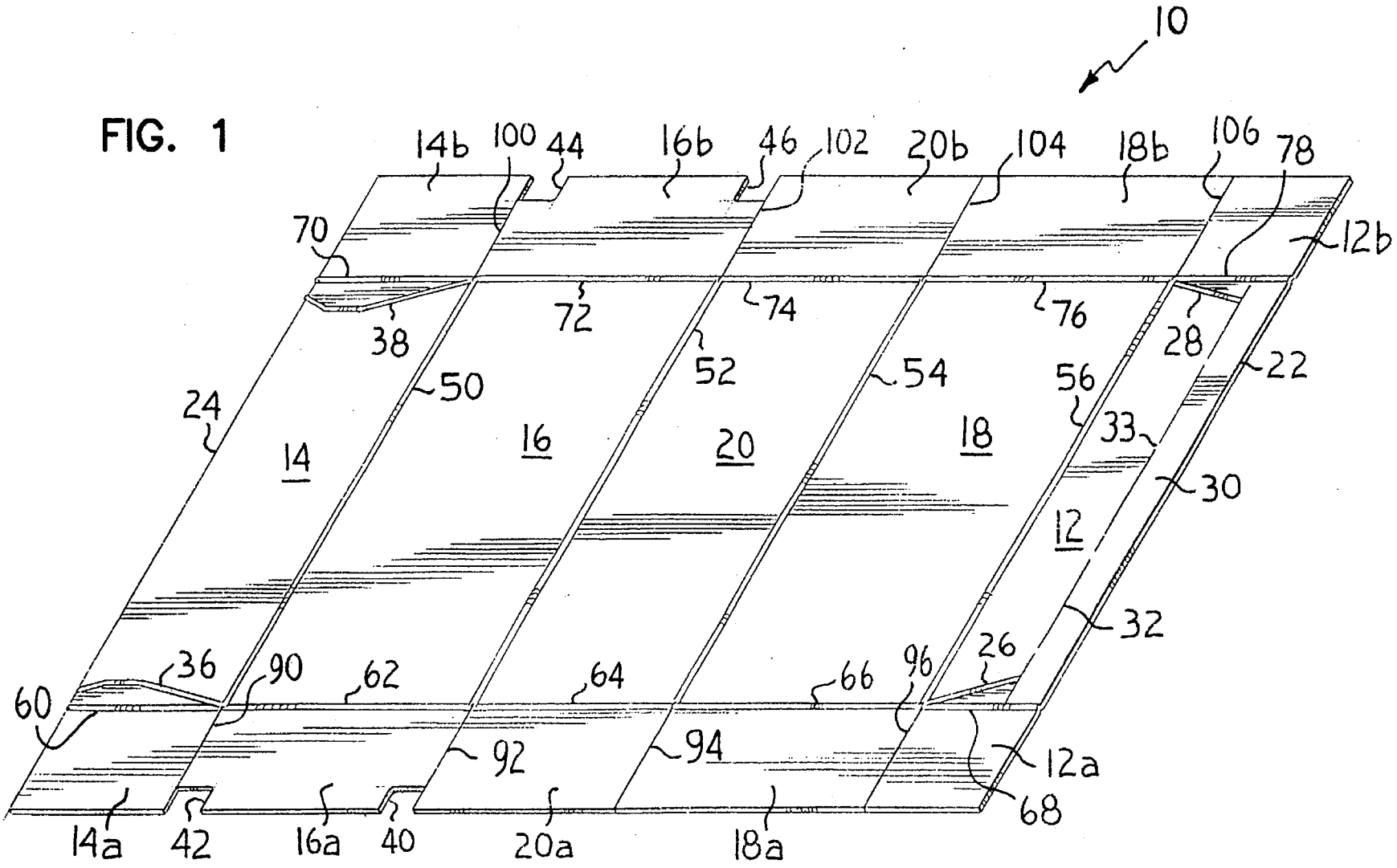
FIG. 1 is a perspective view of one embodiment of a die-cut and scored blank for forming a carton according to the present invention.

One preferred planar unitary blank 10 for forming a carton according to the present invention is illustrated in FIG. 1. Blank 10 can be formed of a unitary piece of paperboard of suitable weight and thickness. The weight and thickness will depend on the size and weight of the articles or materials contained within the finished carton. FIG. 1 illustrates the surface of the blank 10 which will form the interior surface of a carton according to the present invention.

The blank 10 includes two side walls 16 and 18 and a unitary bottom wall 20. A top wall is formed by the combination of panels 12 and 14, each of which has a respective free edge 22 and 24.

Furthermore, each of the bottom wall, side walls and panels 12 and 14 includes a pair of respective flaps indicated as **12*a* and 12*b*, 14*a* and 14*b*, 16*a* and 16*b*, 18*a* and 18*b*, and 20*a* and 20*b* as shown in FIG. 1. Flaps 16*a* and 16*b* preferably include notches 40** formed in its free comers as depicted in FIG. 1.

Each flap is joined to its respective wall/panel by a series of score lines 60, 62, 64, 66 and 68 as depicted in FIG. 1 as well as score lines 70, 72, 74, 76 and 78. Score lines 60 through 78 allow the flaps to be hingedly connected to their respective panels but, in the preferred embodiment, do not perforate the paperboard material used to form the blank 10. Each of the individual flaps is, however, separated .from its adjacent flaps by score lines as shown and indicated at Nos. 90, 92, 94, 96, 100, 102, 104, and 106. Score lines 50, 52, 54 and 56 are also provided between each of the walls/panels 12, 14, 16, 18 and 20 to allow for folding along those lines. In the preferred embodiment, the score lines also do not perforate the paperboard material used to form blank 10.

Additional score lines are provided as indicated at 26 and 28 on panel 12 as well as at 36 and 38 on panel 14. As with the score lines described above, these score lines also do not perforate the paperboard material but are rather supplied only to allow the paperboard material to bend along the given lines. Score lines 26, 28, 36 and 38 (also referred to below as "deflection lines") define the deflection regions described in more detail below.

Panel 12 also preferably includes a handle portion 30 running substantially parallel to free edge 22 of panel 12. Handle 30 is set off from the remainder of panel 12 by a score line 32 which is 5preferably perforated to facilitate separation of handle 30 from the remainder of panel 12. Score line 32 preferably extends only between score lines 68 to 78 as depicted in FIG. 1 so that handle 30 remains attached to blank 10 even if score line 32 is completely separated.

Handle portion 30 can include a reinforcing material such as tape, films, string, fibers, etc. to provide a handle 30 with increased tensile strength. It is preferred that any reinforcing material be thin so as to not affect the height of handle 30 in a carton constructed from blank 10. It is also preferred that the reinforcing material extend onto end flaps **12*a* and 12*b* to more effectively distribute loads from the handle 30 to the carton. The reinforcing material can be located on the exterior or the interior surface of the blank 10**.

Figure 2:
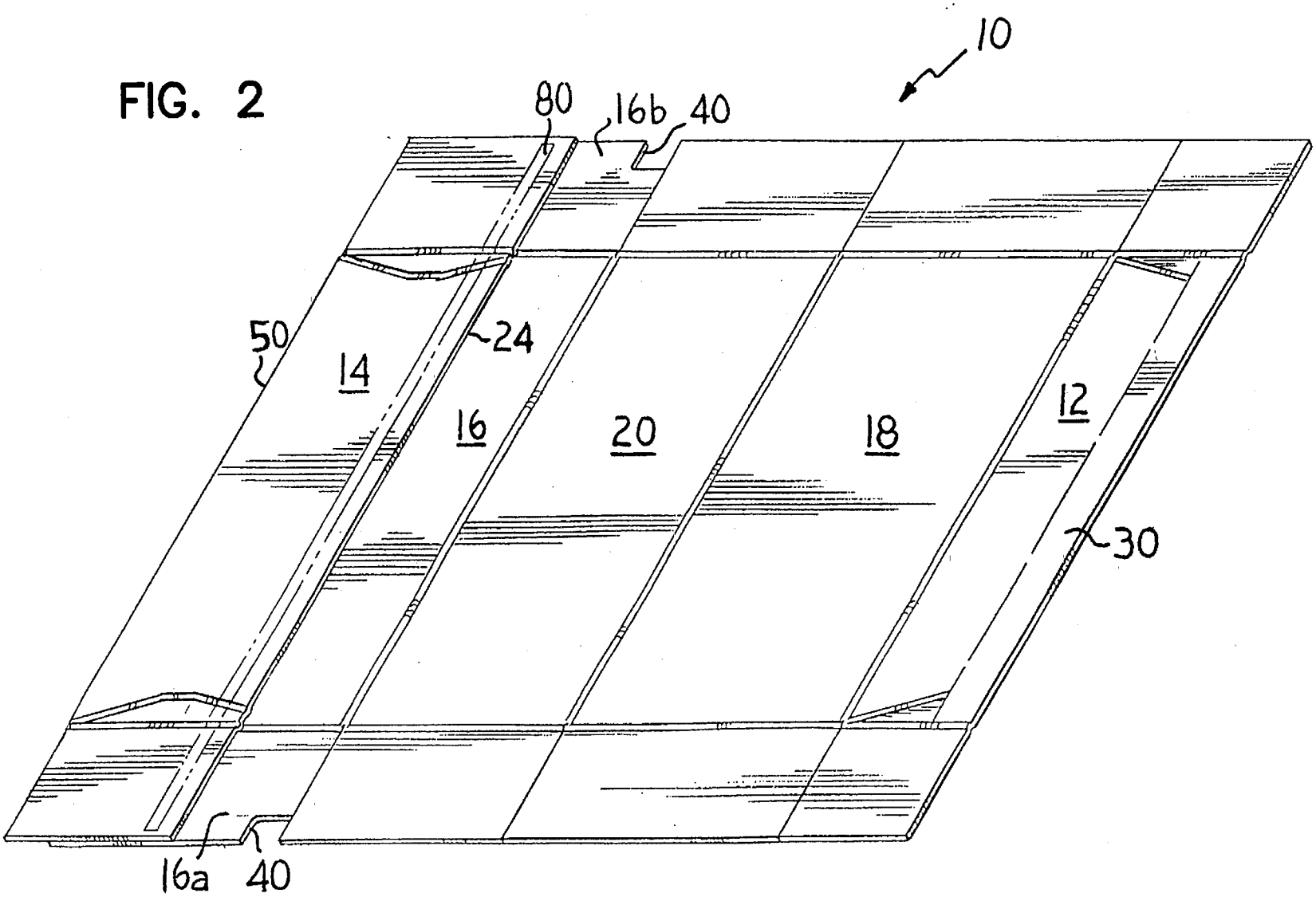
FIG. 2 is a perspective view depicting an initial step in the tubing of the blank of FIG. 1.

Turning to FIG. 2, a partial assembly step is depicted in which the top of panel 14 is folded along score line 50 such that it lies above side panel 16. Adhesive or other attachment means is preferably supplied as indicated at 80 along the entire length of end panel 14 including its end flaps **14*a* and 14B**.

Figure 3:
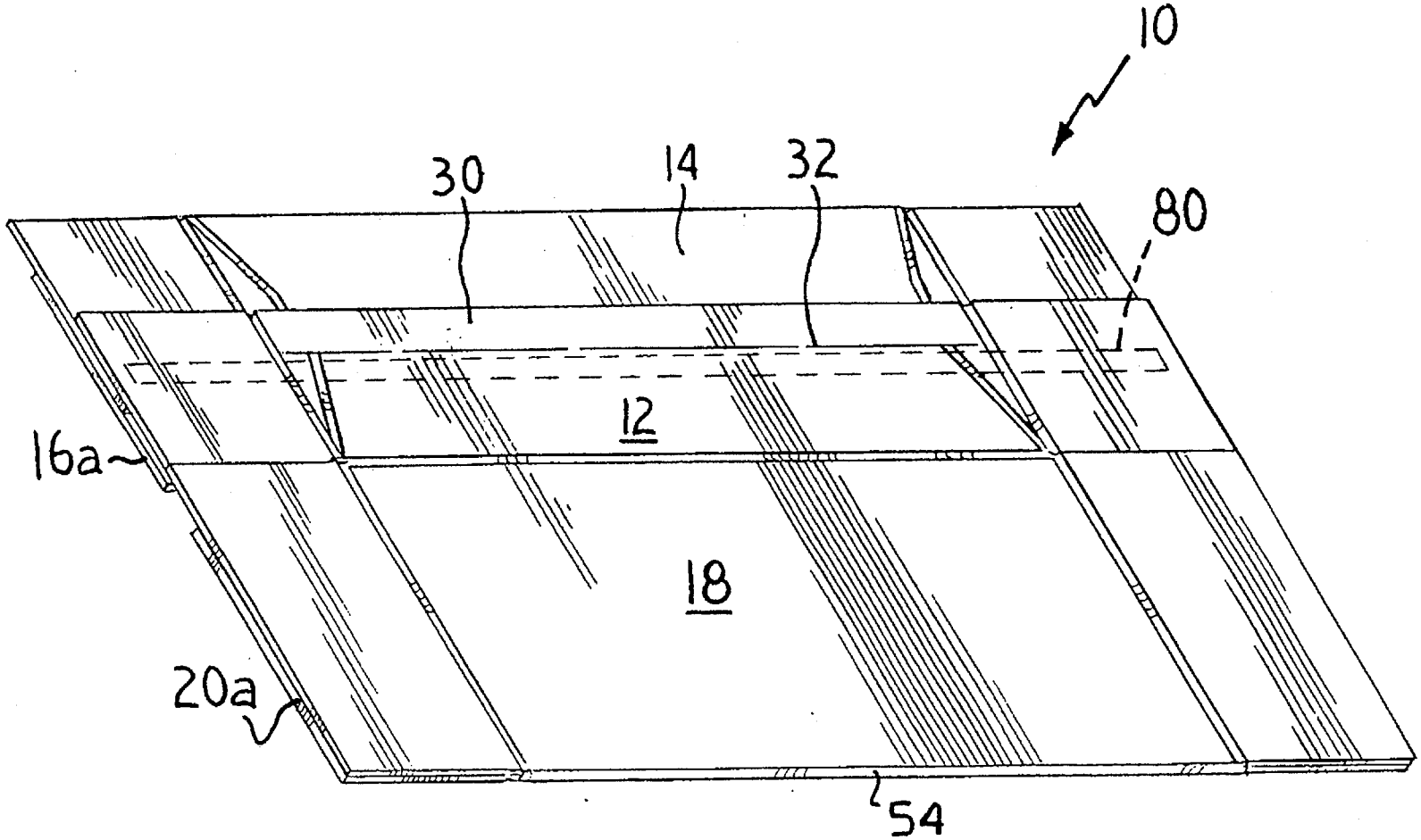
FIG. 3 is a perspective view depicting a subsequent step in the tubing of the blank of FIG. 1.

FIG. 3 depicts a next step in forming a carton from the preferred blank 10. As shown, panel 12 and side wall 18 are folded along score line 54 to lie over bottom wall 20 (not shown) and portions of side wall 16 (not shown) and panel 14.

It is preferred that the dimensions of panel 12, panel 14, side walls 16 and 18 and bottom wall 20 are such that when blank 10 is assembled as shown in FIG. 3, adhesive line 80 is positioned in an adhesive region below panel 12 such that handle portion 30 can be freely separated from panel 12 along score line 32. In other words, adhesive 80 is preferably disposed on the opposite side of score line 32 from handle 30 such that it is located between score line 32 and fold line 56. Blank 10 is now in a partially assembled, collapsed condition from which a carton may be easily formed. In the collapsed condition shown in FIG. 3, however, the blank 10 may be easily shipped and stored prior to use.

Figure 4:
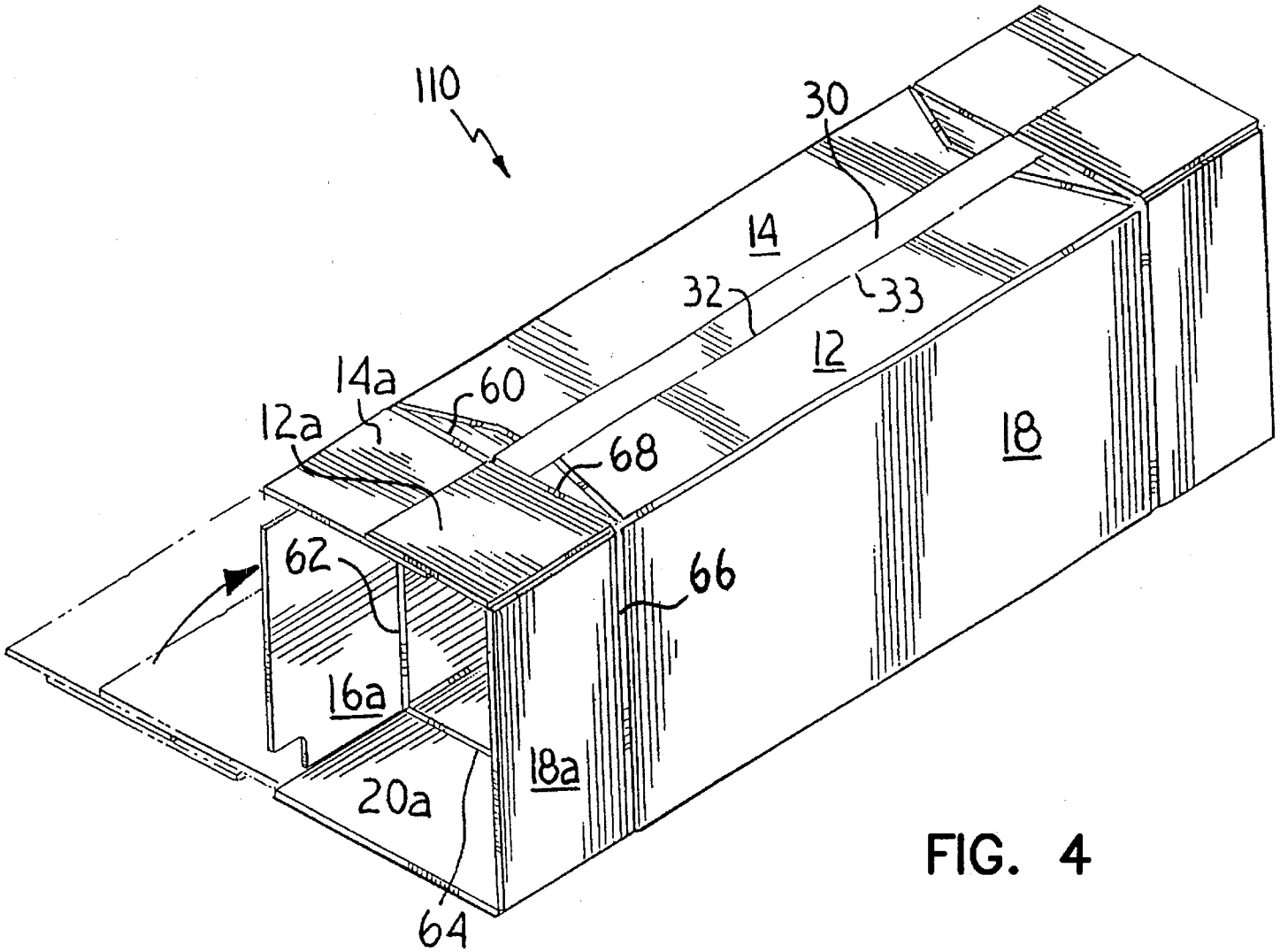
FIG. 4 is a perspective view of the blank of FIG. 1 erected in tubular form.
Figure 5:
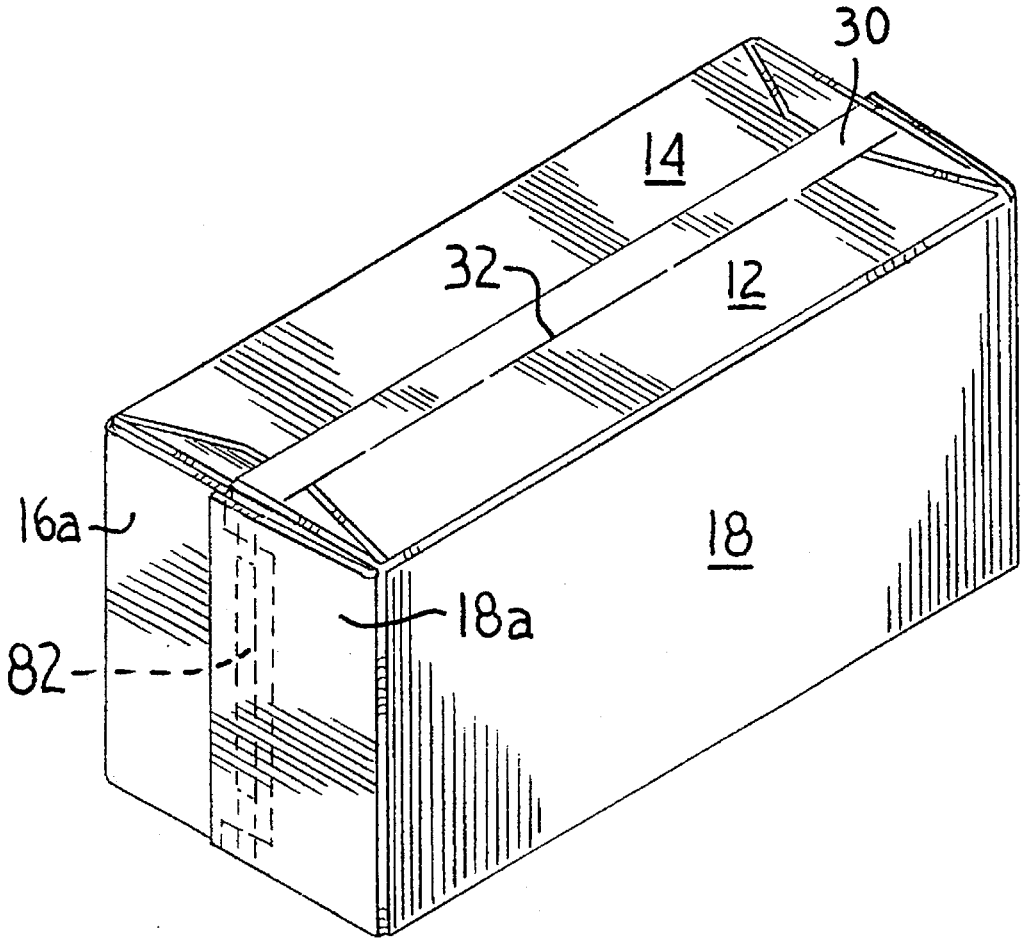
FIG. 5 is a perspective view of a carton formed from the blank of FIG. 1, the carton depicting one embodiment of cartons according to the present invention.

Prior to filling the carton 110, the panels/walls are folded along their respective score lines to form a substantially tubular carton 110 as depicted in FIG. 4. After carton 110 is formed into a tube, the end flaps on one end of the tubular carton 110 can be closed and the carton 110 filled with the desired contents with the other side being closed alter filling as depicted in FIG. 5. Alternatively, it will be understood that both of the carton 110 can be closed simultaneously or sequentially after the carton 110 has been loaded.

Because closing of both ends of the carton 110 is similar, only one end will be described in detail. In the preferred method, end flaps 12*a* and 14*a* are folded downward along their respective fold lines 68 and 60. Simultaneously or sequentially, end flap 20*a* is folded upward along its score lines 64. After all end flaps 12*a*, 14*a* and 20*a* have been positioned, end flap 16*a* is folded over along its score line 62, after which end flap 18*a* is folded over along its score line 66 to substantially close the end of carton 110.

It is preferred that end flap 18*a* include adhesive 82 as depicted in FIG. 5 to secure the ends of carton 110. This adhesive can be applied at any appropriate step in the process described above.

In the preferred embodiment, notches 40 (see FIGS. 1, 2 & 4) allow the adhesive 82 to attach end flap 18*a* to the first top panel end flap 12*a* and, optionally, to the second top panel end flap 14*a*, as well end flap 16*a*. It will be understood that the notches 40 could alternately be provided in end flap 18*a*, in which case the adhesive 82 would be provided on end flap 16*a*, which would then be folded to lie over end flap 18*a*.

The additional bonds result in a stronger end wall construction for carton 110. In addition, the bonds provide a stronger connection between handle 30 and the remainder of carton 110 by distributing the forces from the ends of handle 30 over a number of the end flaps forming the end of the carton 110.

The use of adhesive 82 on only one of the end flaps 18*a* provides yet another advantage of the present invention in that a secure end wall structure and attachment for handle 30 can be provided with adhesive applied only to a single end flap, thereby reducing the need for additional adhesive applicators as well as additional adhesive.

Although adhesive is the preferred means of attachment between the end flaps and top panels, it will be understood that mechanical fasteners such as staples, etc. could be substituted.

The finished, assembled carton 110 is depicted in FIG. 5. In this configuration, handle portion 30 lies flat against the panel 14 to facilitate stacking of cartons 110. It is also preferred that, at this time, the land portions 33 of score line 32 (see FIGS. 1 and 5) remain intact to facilitate in retaining handle 30 flat against panel 14.

Figure 8:
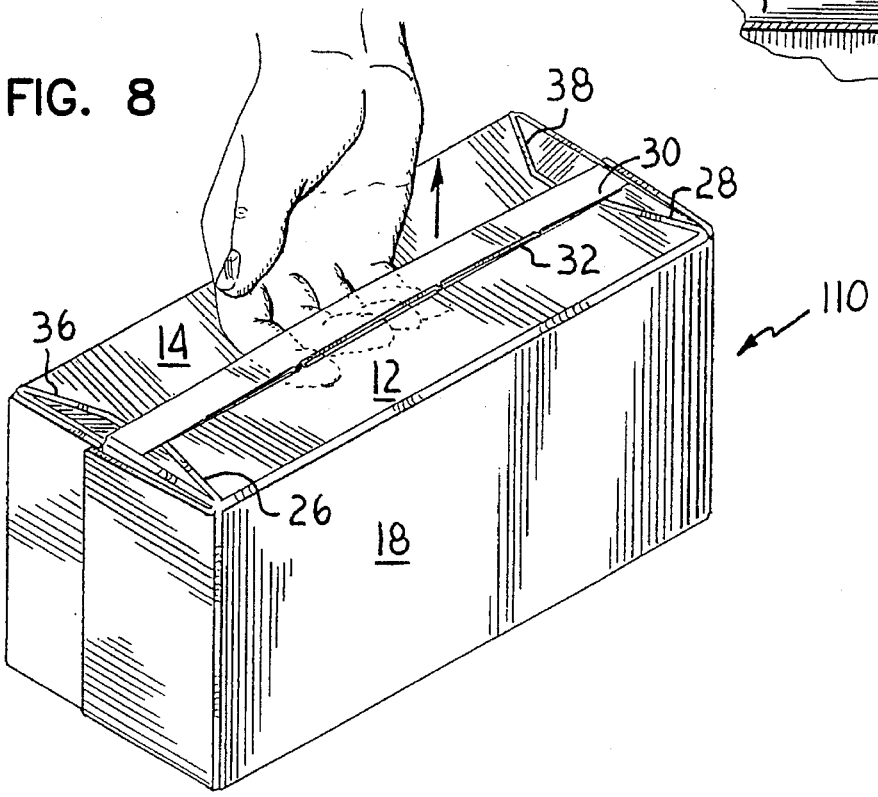
FIG. 8 is a perspective view of the carton of FIG. 5 depicting the separation of the handle from a panel forming the top wall.

FIG. 6 depicts use of a preferred carton 110 formed according to the present invention. As shown, a user will preferably force panel 14 downwardly towards bottom wall 20 (not shown) of carton 110. As such, a space will be opened between handle 30 and panel 14, allowing the user to pull upwardly on handle 30 as shown in FIG. 8, thereby separating handle 30 from the remainder of panel 12 along score line 32.

Figure 7:
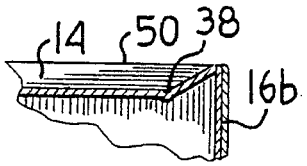
FIG. 7 is a sectional view taken along line 7—7 in FIG. 6 depicting the movement or deflection of the top wall toward the interior of the carton to facilitate the initial and subsequent grasping of the handle.

In the above sequence of events, deflection lines 26, 36, 28 and 38 play an important role in that they allow deflection of panel 14. This is depicted in FIG. 7 which is a cross sectional view along lines 7–7 in FIG. 6. As depicted in FIG. 7, deflection line 38 is moved downwardly with respect to the edge of carton 110 formed by the fold along score line 50. Although the deflection is depicted as downward in FIG. 7, it will be understood that in some instances the deflection line 38 may move upward with respect to the edge of the carton 110.

Separation of handle 30 from panel 12 along score line 32 is also facilitated by the placement of adhesive 80 as described in conjunction with FIGS. 2 and 3 above. As a result, panel 12 preferably remains attached to panel 14 which also ensures that carton 110 remains substantially sealed after handle 30 has been detached from the remainder of panel 12.

Figure 9:
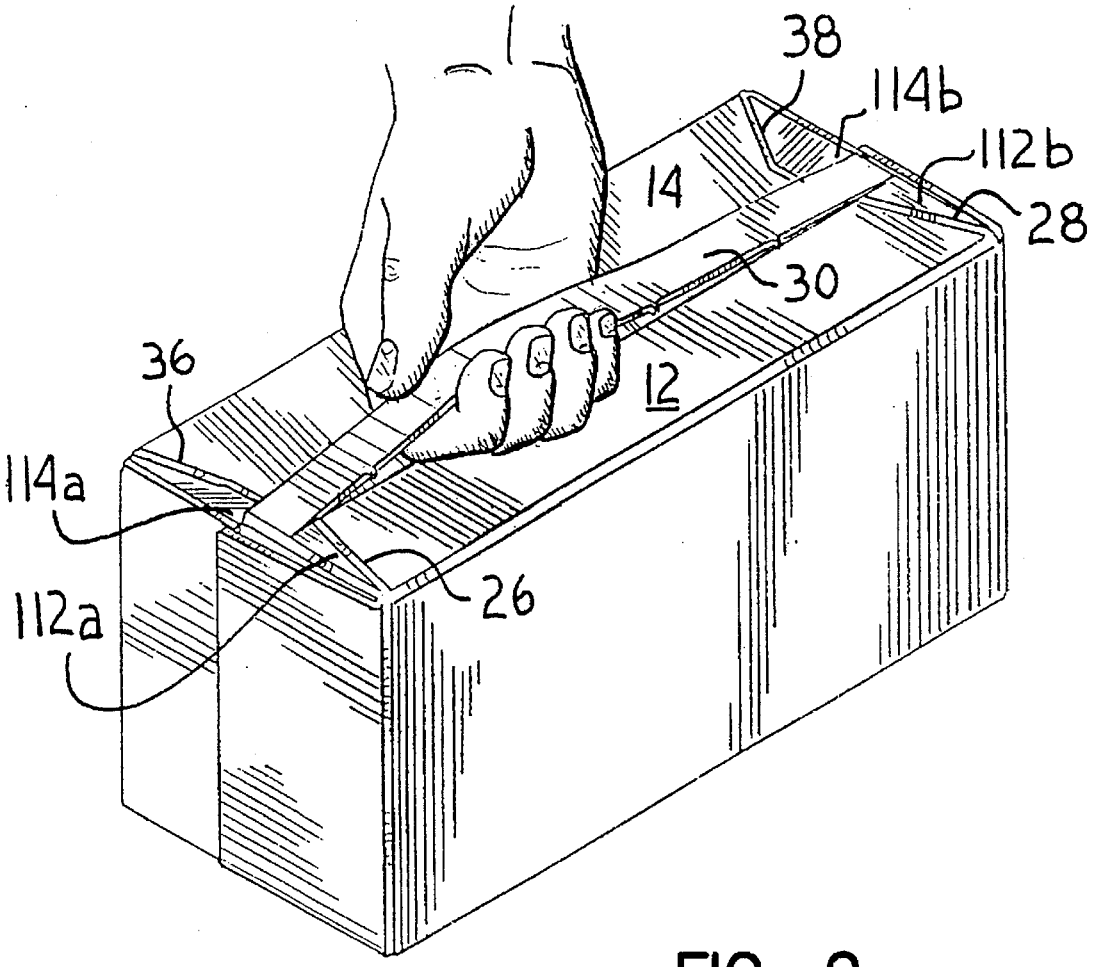
FIG. 9 is a perspective view depicting lifting and carrying of the carton o f FIG. 5.

FIG. 9 depicts carton 110 after complete separation of panel 30 from panel 12 whereby a user is able to firmly grasp handle 30 to place carton 10. It is during lifting of the carton 110 and its contents during which deflection areas defined by deflection lines 26, 36, 28 and 38 provide one advantage of the carton 110 according to the present invention. As the user lifts upward on handle 30, the weight of the carton 110 and its contents result in tension along handle 30 which is transferred to end panels 12*a*, 12*b*, 14*a* and 14*b*. As a result, panel 12 and panel 14 are both urged downwardly and deflection score lines 26, 36, 28 and 38 are bent such that deflection regions 112*a* , 112*b*, 114*a* and 114*b* are sloped downwardly (or, in some cases upwardly) from the ends of carton 110.

Providing deflection lines 26, 36, 28 and 38 to promote the deflections of regions 112*a*, 112*b*, 114*a* and 114*b* overcomes one of the disadvantages of associated with prior art packages in which deflection regions were not provided. As described in the background of the invention, cartons formed without these deflection regions tended to tear when loads were placed on handle 30 because the stresses inherent in caring the carton were not effectively managed. By providing the deflection lines and deflection regions as described above, the present invention manages the stresses involved to provide a carton which resists tearing and failure of the handle 30 during use while also providing an enclosed carton which defines a completely enclosed volume for containing granular materials.

In addition to the deflection regions, the preferred cartons according to the present invention in which the end flap 12*a* (associated with the panel 12 from which handle 30 is formed) is attached to the side wall end flap 18*a* also promotes a distribution of the stresses associated with carrying the cartons by the handle 30 into the end wall structure. By providing attachment of the end walls using adhesive on only one end flap, the cartons can further be economically manufactured.

Although the description of the preferred embodiment has been presented, it is contemplated that various changes, including those mentioned above, could be made without deviating from the spirit of the present invention. It is desired, therefore, that the present embodiment be considered in all respects as illustrative, not restrictive, mad that reference be made to the appended claims rather than to the foregoing description to indicate the scope of the invention.

What is claimed is:

1. A carton comprising:

a) a top wall comprising a first panel foldably attached to a first side wall along a first fold line and a second panel foldably attached to a second side wall along a second fold line, each of the first and second panels having a free edge, the first panel overlapping and secured to the second panel to form the top wall;

b) an integral carrying handle defined by a line of weakness in the first panel, the line of weakness generally parallel to the free edge of the first panel, the handle having a thickness substantially equal to the thickness of the first panel and a width less than an overlapping width of the first and second panels; and c) two deflection regions located in the top wall, each deflection region located proximate opposing ends of the top wall, each deflection region being defined by:
1) a first deflection line in the first panel, the first deflection line extending from an end of the first fold line towards the free edge of the first panel; and
2) a second deflection line in the second panel, the second deflection line extending from an end of the second fold line towards the free edge of the second panel, the second deflection line intersecting the first deflection line when the first and second panels are secured together to form the top wall.

2. A carton according to claim 1, wherein each of the first deflection lines extend from an end of the first fold line to the line of weakness defining the handle in the first panel.

3. A carton according to claim 1, wherein a portion of each of the second deflection lines lies substantially directly beneath each of the corresponding first deflection lines when the first and second panels are secured together to form the top wall.

4. A carton according to claim 3, wherein each of said second deflection lines extends from an end of the second fold line to the free edge of the second panel.

5. A carton according to claim 1, further comprising end walls located at opposing ends of the top wall, each end wall comprising:

1) first and second top end flaps foldably connected to each of the first and second panels, respectively;
2) first and second side end flaps foldably connected to each of the first and second side walls, respectively, wherein the first top end flap is attached to one of the side end flaps.

6. A carton according to claim 5, wherein the side end flap attached to the first top end flap is also attached to the opposing side end flap, and yet further wherein the opposing side end flap includes a notch to allow the attachment between the side end flap attached to the first top end flap and the first top end flap.

7. A carton according to claim 6, wherein the attachments between end flaps are adhesive attachments, and timber wherein the adhesive is applied only to the side end flap attached to the first end flap.

8. A carton according to claim 1, wherein the line of weakness defining the handle comprises a cut.

9. A carton according to claim 8, wherein the line of weakness includes land portions connecting the handle to the first panel.

10. A carton according to claim 1, wherein the first panel is adhesively secured to the second panel at an adhesive region located between the line of weakness defining the handle and the first fold line.

11. A carton according to claim 1, wherein the handle further comprises a reinforcing member.

12. A carton according to claim 11, wherein the reinforcing member is chosen from the group consisting of tape, string, fibers, films.

13. A carton according to claim 1, further comprising a bottom wall located opposite the top wall and foldably connected to the first and second side walls and a pair of end walls foldably connected to the top, bottom and side walls, wherein the carton defines a completely enclosed volume.

14. A carton comprising:

a) a top wall comprising a first panel foldably attached to a first side wall along a first fold line and a second panel foldably attached to a second side wall along a second fold line, each of the first and second panels having a free edge, the first panel overlapping and secured to the second panel to form the top wall;

b) an integral carrying handle portion defined by a line of weakness in the first panel, the line of weakness generally parallel to the free edge of the first panel, the handle having a thickness substantially equal to the thickness of the first panel;

c) two deflection regions located in the top wall, each deflection region located proximate opposing ends of the top wall, each deflection region being defined by:
1) a first deflection line in the first panel, the first deflection line extending from an end of the first fold line to the line of weakness defining the handle in the first panel; and
2) a second deflection line in the second panel, the second deflection line extending from an end of the second fold line to the free edge of the second panel, wherein a portion of the second deflection line lies substantially directly beneath the first deflection line when the first and second panels are secured together to form the top wall;

d) a bottom wall located opposite the top wall and foldably connected to the first and second side walls; and e) a pair of end walls foldably connected to the top, bottom and side walls, wherein the carton defines a completely enclosed volume, and further wherein each end wall comprises:
1) first and second top end flaps foldably connected to each of the first and second panels, respectively;
2) first and second side end flaps foldably connected to each of the first and second side walls, respectively, wherein the first top end flap is attached to one of the side end flaps, and further wherein the side end flap attached to the first top end flap is also attached to the opposing side end flap, and yet further wherein the opposing side end flap includes a notch to allow the attachment between the side end flap attached to the first top end flap and the first top end flap.

15. A blank for forming a carton defining a completely enclosed volume comprising:

a) a first panel foldably attached to a first side wall along a first fold line, the first panel having a free edge generally parallel to the first fold line;

b) a second panel foldably attached to a second side wall along a second fold line, the second panel having a free edge;

b) an integral carrying handle portion in the first panel defined by a line of weakness generally parallel to the free edge of the first panel, the handle portion having a thickness substantially equal to the thickness of the first panel;

c) a first deflection line in the first panel, the first deflection line extending from an end of the first fold line towards the free edge of the first panel; and d) a second deflection line in the second panel, the second deflection line extending from an end of the second fold line towards the free edge of the second panel.

16. A blank according to claim 15, wherein the first deflection line extends from an end of the first fold line to the line of weakness defining the handle in the first panel.

17. A blank according to claim 15, wherein the second deflection line extends from an end of the second fold line to the free edge of the second panel.

18. A blank according; to claim 15, further comprising:

1) first and second top end flaps foldably connected to each of the first and second panels, respectively, 2) first and second side end flaps foldably connected to each of the first and second side walls, respectively, one of the side end flaps including a notch proximate each of its free comers and the other side end flap including adhesive.

19. A blank according to claim 15, wherein the line of weakness defining the handle comprises a cut.

20. A blank according to claim 19, wherein the line of weakness includes land portions connecting the handle to the first panel.

21. A blank according to claim 15, wherein the handle further comprises a reinforcing member.

22. A blank according to claim 21, wherein the reinforcing member is chosen from the group consisting of tape, string, fibers, films.

23. A blank according to claim 15, further comprising a bottom wall located opposite the top wall and foldably connected to the first and second side walls and a pair of end flaps foldably connected to opposing ends of each of the bottom wall, side walls and first and second panels.

24. A blank for forming a carton defining a completely enclosed volume comprising:

a) a first panel foldably attached to a first side wall along a first fold line, the first panel having a free edge generally parallel to the first fold line;

b) a second panel foldably attached to a second side wall along a second fold line, the second panel having a free edge;

b) an integral carrying handle portion in the first panel defined by a line of weakness generally parallel to the free edge of the first panel, the line of weakness further comprising a cut and land portions connecting the handle to the first panel, the handle portion having a thickness substantially equal to the thickness of the first panel;

c) a first deflection line in the first panel, the first deflection line extending from an end of the first fold line to the line of weakness defining the handle portion of the first panel; and d) a second deflection line in the second panel, the second deflection line extending from an end of the second fold line to the free edge of the second panel.

* * * * *

UNITED STATES PATENT AND TRADEMARK OFFICE

CERTIFICATE OF CORRECTION

PATENT NO. : 5,472,136

DATED : December 5, 1995

INVENTOR(S) : Harry I. Roccaforte

It is certified that error appears in the above-identified patent and that said Letters Patent is hereby corrected as shown below:

Column 7 Line 40 "timber" should read --further-- therefor.

Column 8 Line 66 "according;" should read --according-- therefor.

Column 9 Line 5 "comers" should read --corners-- therefor.

Signed and Sealed this

Twenty-eighth Day of October, 1997

*Attest:*

Bruce Lehman

BRUCE LEHMAN

*Attesting Officer*

*Commissioner of Patents and Trademarks*